US005505401A

United States Patent [19]

Lamothe

[11] Patent Number: 5,505,401

[45] Date of Patent: Apr. 9, 1996

[54] MACHINE FOR MANIPULATING WEB MATERIAL

[76] Inventor: Richard P. Lamothe, 62 Ford Rd., Burlington, Conn. 06013

[21] Appl. No.: 218,512

[22] Filed: Mar. 25, 1994

[51] Int. Cl.[6] ..... B65H 59/38

[52] U.S. Cl. ..... 242/412.2; 242/420.3; 242/541.3; 242/564.5

[58] Field of Search ..... 242/413.3, 418, 242/418.1, 419.1, 419.5, 420.2, 420.3, 541.3, 559.4, 564.4, 564.5, 598.3, 599.3, 533.8, 412.2; 226/113, 118

[56] References Cited

U.S. PATENT DOCUMENTS

| | | | |
|---|---|---|---|
| 3,537,665 | 11/1970 | Shumaker | 242/599.3 |
| 3,796,390 | 3/1974 | Melead | 242/418.1 |
| 3,989,201 | 11/1976 | Cottrell | 242/420.2 |
| 4,025,005 | 5/1977 | Fleck et al. | 242/413.3 |
| 4,173,314 | 11/1979 | Curran et al. | 242/420.3 |
| 4,253,597 | 3/1981 | Waffner | 242/418.1 |
| 4,265,413 | 5/1981 | Burns et al. | 242/413.3 |
| 4,384,665 | 5/1983 | Waddington . | |
| 4,676,448 | 6/1987 | Kofler | 242/533.8 |
| 4,729,522 | 3/1988 | Tafel et al. | 242/418.1 |
| 4,893,763 | 1/1990 | Wales et al. | 242/420.3 |
| 5,000,394 | 3/1991 | Wales et al. . | |
| 5,187,531 | 2/1993 | Ozawa et al. | 242/564.4 |
| 5,234,146 | 8/1993 | Meschi | 226/118 |
| 5,344,089 | 9/1994 | Crowley et al. | 242/418 |

FOREIGN PATENT DOCUMENTS

| | | | |
|---|---|---|---|
| 1258911 | 12/1971 | United Kingdom | 242/564.4 |

*Primary Examiner*—Daniel P. Stodola
*Assistant Examiner*—William A. Rivera
*Attorney, Agent, or Firm*—McCormick, Paulding & Huber

[57] ABSTRACT

A roll-to-roll paper web feeding system for a laser printer. The paper web is unwound from a roll supported in the unwind machine by a single conveyor belt driven at a speed that varies to match the web feed to the speed of the printer. A pivotably mounted beam houses the belt and can be raised to permit replacement of the roll. A shock absorber acts between the beam and the machine frame to maintain contact between the belt and the paper roll. Replacement of the belt is facilitated by a unique latch acting on the support shaft for a sprocket at the free end of the beam provided for the belt. The paper web is rewound on a roll provided in the rewind machine. Tension must be kept high enough in the paper web to assure a tightly wrapped roll in the rewind machine. This fact requires a friction, or drag roller, to maintain at least one free loop of web, and this drag roller can be replaced quickly as a result of shifting it laterally to decouple the coupling provided at one end of the drag or friction roller.

18 Claims, 7 Drawing Sheets

MACHINE FOR MANIPULATING WEB MATERIAL

This invention relates generally to apparatus for supporting rolls of web material to be fed into or to be reclaimed from a utilization device. The utilization device may comprise a high speed laser printer of the type which operates at widely varying speed to print selected indicia on preprinted advertising material or the like.

BACKGROUND OF THE INVENTION

Prior art web feeding machines of the type adapted to handle rolls of preprinted paper for delivery to or reclamation from a laser printer have evolved into relatively complicated structures with all the inherent disadvantages of these complications. For example, the machine shown in prior art U.S. Pat. No. 5,000,394 includes an elevator structure for lifting the paper roll into position by means of a vertically mounted carriage including laterally movable arms for engage the end of the paper roll core. Changes in the speed of the paper web to accommodate changes in speed of the laser printer are also available and have taken the form of a tension free loop in the paper web between the printer and the paper roll. The paper roll is generally driven by a relatively short pair of belts provided in a pivoted arm structure that drives the roll peripherally to provide the web from the bottom of the roll, over a series of rollers to form the tension free loop. The speed of the belts is controlled by an ultrasonic detector so located as to sense the depth of the tension free loop. A control circuit uses this information to regulate the speed of the drive belts and hence the rate at which the web travels.

In a typical installation where paper web is to be fed at widely varying speeds to a laser printer unwind stands of this general type often require replacement of these drive belts. The present invention seeks to minimize the downtime required on such a machine by providing for expeditious replacement of such belts by reason of the fact that only one such belt is required in the unwind machine to be described, and also because the belt itself can be readily slackened to permits its removal for replacement purposes.

In machines for reclaiming or rewinding the paper web discharged from a laser printer or the like there is a need for providing a constant tension in the web material being rewound on the roll while at the same time maintaining a tension free loop between the rewind machine and the utilization device or laser printer. The paper roll in such a rewind machine is generally driven by one or more driven rollers rather than by drive belts. The present invention provides a unique path of travel for the web so as to maintain this tension in the web as it is rewound on the roll. An important feature of the present invention is that the paper web is wrapped around a significant peripheral portion of a friction roller provided in the machine for this purpose. The friction roller permits at least one tension free loop to be formed between the laser printer and the rewind machine without sacrificing the tension in the paper web between such friction roller and the roll of paper being rewound. Such friction rollers tend to wear however, and hence removal of the friction roller for replacement or for repair is often necessary. The machine to be described meets this need.

Among the objects of the present invention then are to provide a less complicated, less expensive machine for winding, and a machine for rewinding paper, fed to or received from a utilization device such as a laser printer. Since the paper rolls normally handled by such machines are quite heavy, on the order of 750 to 1500 pounds, it is generally necessary to provide for hydraulic hand trucks or the equivalent to move these paper rolls from one area of a typical printing installation to the vicinity of the laser printer. Furthermore, the typical hydraulic hand cart can be utilized to lift the paper rolls into or out of rewind and winder machines without the need for the machine itself providing a mechanism for lifting the roll. Recognition of this fact has led to the uncomplicated, and hence lower cost winder and rewinder machines to be described.

Another important feature of the present invention can be traced to the accommodation of conventional pneumatic air shaft for supporting the roll of paper in the machine frame, As a result of preassembling such a pneumatic roll core shaft with a paper roll prior to installation of the combination in the machine, the machine itself can be less complicated leading to less downtime and hence improves productivity for the overall combination of unwind machine laser printer and rewind machine.

SUMMARY OF THE INVENTION

In accordance with present invention a machine is provided for manipulating web material between a roll and a utilization means such as a laser printer. The machine comprises a frame including a base, and upright supports extending from the middle of the base. The base includes spaced vertically extending side walls that define horizontally spaced sockets for receiving the ends of a pneumatic roll core shaft. The ends of the shaft are preferably provided with bearings that are received in plastic blocks that define these spaced sockets. A variable speed drive is provided that includes a driven belt in the case of the unwind machine, and that includes a driven roller in the case of the rewind machine. The driven member engages the periphery of the roll for rotating the roll in the desired direction. The machine is designed to accommodate rotation in both the clockwise and counterclockwise direction. The driven belt or roller is supported in a movable structure mounted to the upright supports so that the driven belt or roller contacts the periphery of the roll to accommodate changes in the roll diameter. Means is provided for guiding the web during its movement between the utilization means and the roll from which it is unwound or on which it is being rewound, and this web guiding means includes a web tensioning roller having a substantial portion of its periphery defining a path for the web. Further, the web guiding means includes spaced web supporting rollers for creating a first tension free web loop. Ultrasonic sensing means is provided above the loop for detecting changes in the loop length, and control means responsive to said sensing means changes the speed of the variable speed drive means to maintain a predetermined loop length, or at least to maintain this loop length within predetermined limits.

Further features of the present invention are that the means for supporting the driven belt or roller comprises a pivoted beam supported on a horizontal axis defined at the top or the upright supports. The upright supports comprise posts which project upwardly from the side walls of the base.

Still another feature of the present invention can be traced to the means for selectively moving this pivoted beam upwardly away from the roll to permit removal or replacement of the roll of paper. In addition the unwind machine includes biasing means provided between the frame base and the pivoted beam to maintain appropriate contact pressure between the driven belt and the roll of paper.

In the rewind machine the roll of paper is driven by a single roller such that the web of paper withdrawn from the roll passes over a plate provided in the upper portion of the pivoted support beam. The paper web is provided around a major portion of the periphery of a drag or friction roller which maintains tension in the web between the roll of paper being rewound and a tension free loop of web material between the drag roller and the roll of paper. This drag roller is designed to be readily removed for replacement or repair by providing a coupling at one end of the roller and a spring loaded stub shaft fitted into a self aligning socket at the opposite end of the roller.

Still with reference to the paper roll rewind machine the provision of a single tension free loop may not provide sufficient accumulation of web material between the utilization devices and the roll being rewound when the abrupt changes in speed characteristic of present day laser printers must be accommodated. Therefore, provision is made for a second tension free loop to provide an added margin of slack web material to accommodate abrupt start up speeds of the laser printer, all without the need for providing expensive vertically movable dancer roles or festoon type roller combinations to accommodate additional web material between the utilization device and the paper roll being rewound.

BRIEF DESCRIPTION OF THE DRAWINGS

A more complete understanding of the invention and many of the attendant advantages will be readily appreciated as the same becomes better understood by reference to the following detailed description when considered in conjunction with the accompanying drawings wherein.

DETAILED DESCRIPTION

Figure 1:
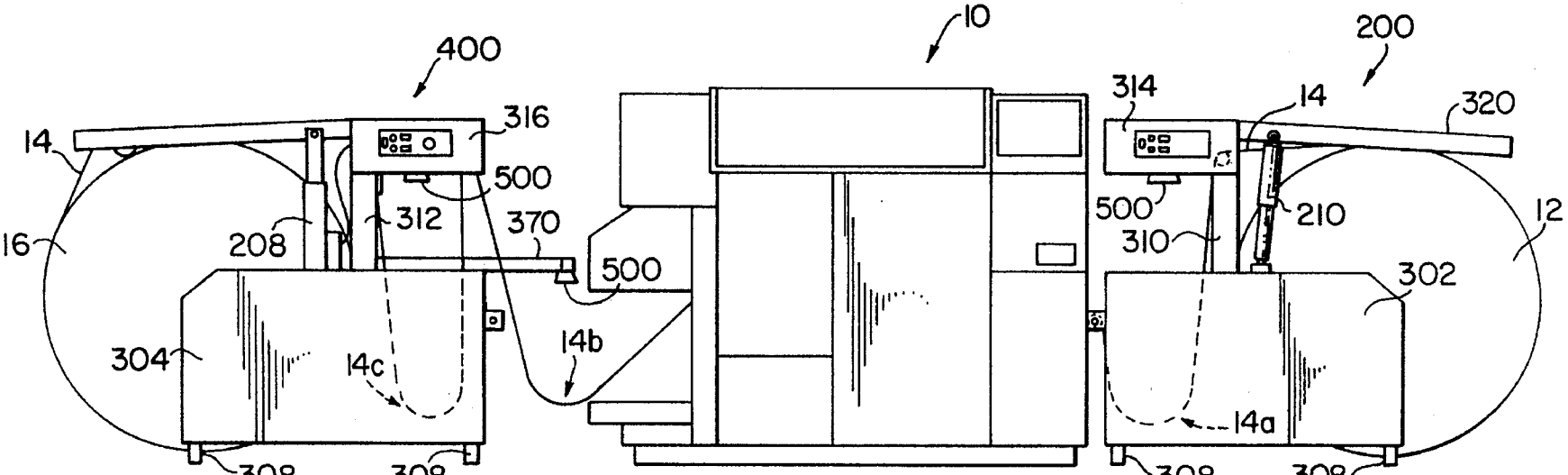
FIG. 1 shows in elevation a typical high speed laser printer provided between an unwind machine and a rewind machine of the present invention.

Turning now to the drawings in greater detail, FIG. 1 shows a utilization device in the form or a laser printer 10 of the type manufactured by Siemens. Such a printer is representative of utilization devices that must be provided with a continuous stream of web material, the printer being capable of moving the web material through the printer at a range of speeds including a stop condition sometimes necessary for internal purposes in connection with self cleansing or maintenance reasons designed in the laser printer by the manufacturer.

At the right hand side of FIG. 1 a paper roll 12 is shown rotatably supported in an unwind machine 200 to be described. This unwind machine 200 includes means for rotating the paper roll 12 for feeding the web of paper from the roll indicated generally at 14 into the laser printer 10. The unwind machine 200 includes provisions for forming a tension free loop 14*a* of the web material between itself and the laser printer 10.

The installation of FIG. 1 is a so-called roll to roll setup wherein the paper web material is initially provided on a paper roll 12 and downstream of the laser printer 10 is rewound on a paper roll 16 at the left hand side of the setup shown in a rewind machine 400. The paper web 14 moves through two tension free loops 14*b* and 14*c* between the laser printer 10 and the rewind machine 400. These loops 14*b* and 14*c* provide an accumulation of web material between the rewind machine and the paper roll. The paper web must be rewound under a significant tension however and drag or friction means is provided in the rewind machine to assure that the paper roll 16 is rewound compactly.

Figure 8:
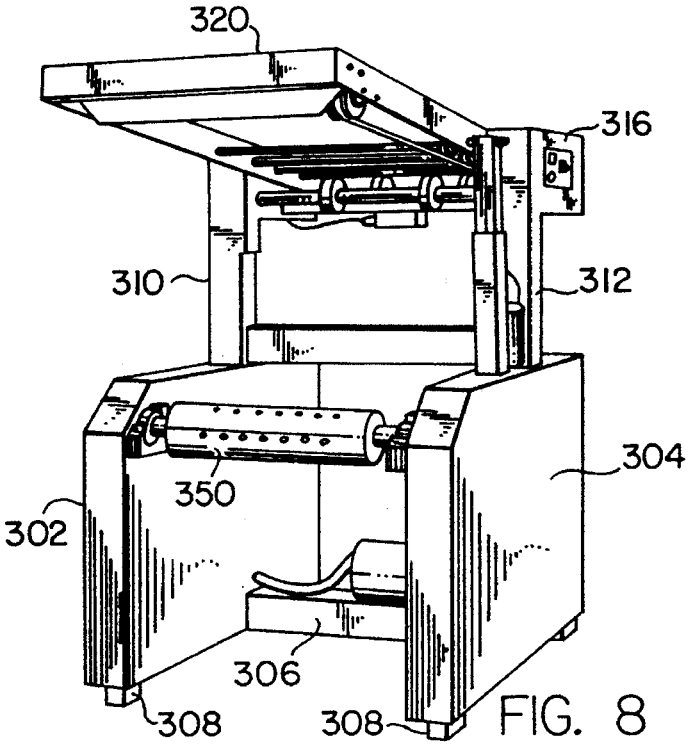
FIG. 8 is a perspective view taken from the forward left side of the rewind machine.
Figure 9:
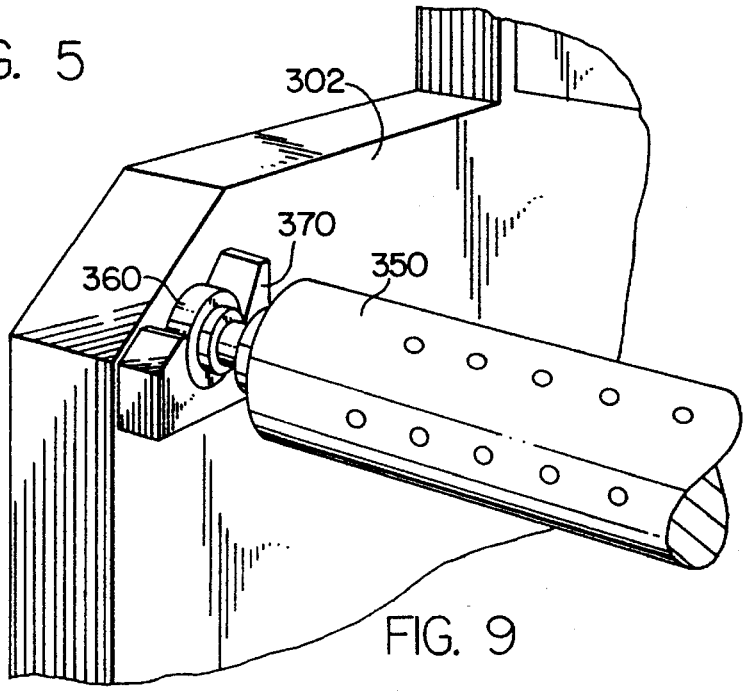
FIG. 9 is a detailed view taken from the same vantage point of that of FIG. 8 illustrating the support for one end of the pneumatic roll core shaft in the rewind machine. The roll core shaft in turn supports the paper roll (not shown).

The frames for both the unwind machine 200 and the rewind machine 400 are of similar construction and FIGS. 8 and 9 illustrate in perspective the overall configuration for these frames. These frames include a base portion defined by vertically extending side walls 302 and 304 oriented in laterally spaced relationship relative to one another, and a lower cross beam 306 that supports the lower edges of the vertically extending side walls. Each side wall 302 and 304 is fabricated of a hollow steel box construction with welded up edge walls, and feet 308, 308 are provided at the lower edge of each vertically extending side wall.

Still with reference to the frame, upright supports 310 and 312 have cantilevered arms 314 and 316 at their upper ends. The upper ends of these upright supports 310 and 312 also provide pivotal support for a beam structure 320 that houses the drive means for the paper roll 12 in the unwind and the roll 16 in the rewind machine. These paper rolls typically have a cardboard core, and this core is of a known internal diameter so as to receive a pneumatic roll core shaft of the type indicated generally at 350 in FIGS. 8 and 9. The roll core shaft 350 includes radially extendible gripping plugs that are pneumatically operated to grip the core of the paper roll. The end portions of the roll core shaft carry roller bearings as indicated generally at 360. The outer race of each roller bearing is adapted to be received in a U-shaped socket as indicated generally at 370 in FIG. 9.

In operation the paper roll 12 in the unwind machine 200 is provided with the roll core shaft, and then lifted into position in the machine by a hydraulic cart or the like. The paper web is then threaded from the roll 12 in FIG. 2 though a series of guide rollers and wheels so as to form a tensionless free loop, such as indicated generally at 14*a* in FIG. 2, for delivery to the laser printer in the direction indicated at the left hand side of FIG. 2.

Figure 3:
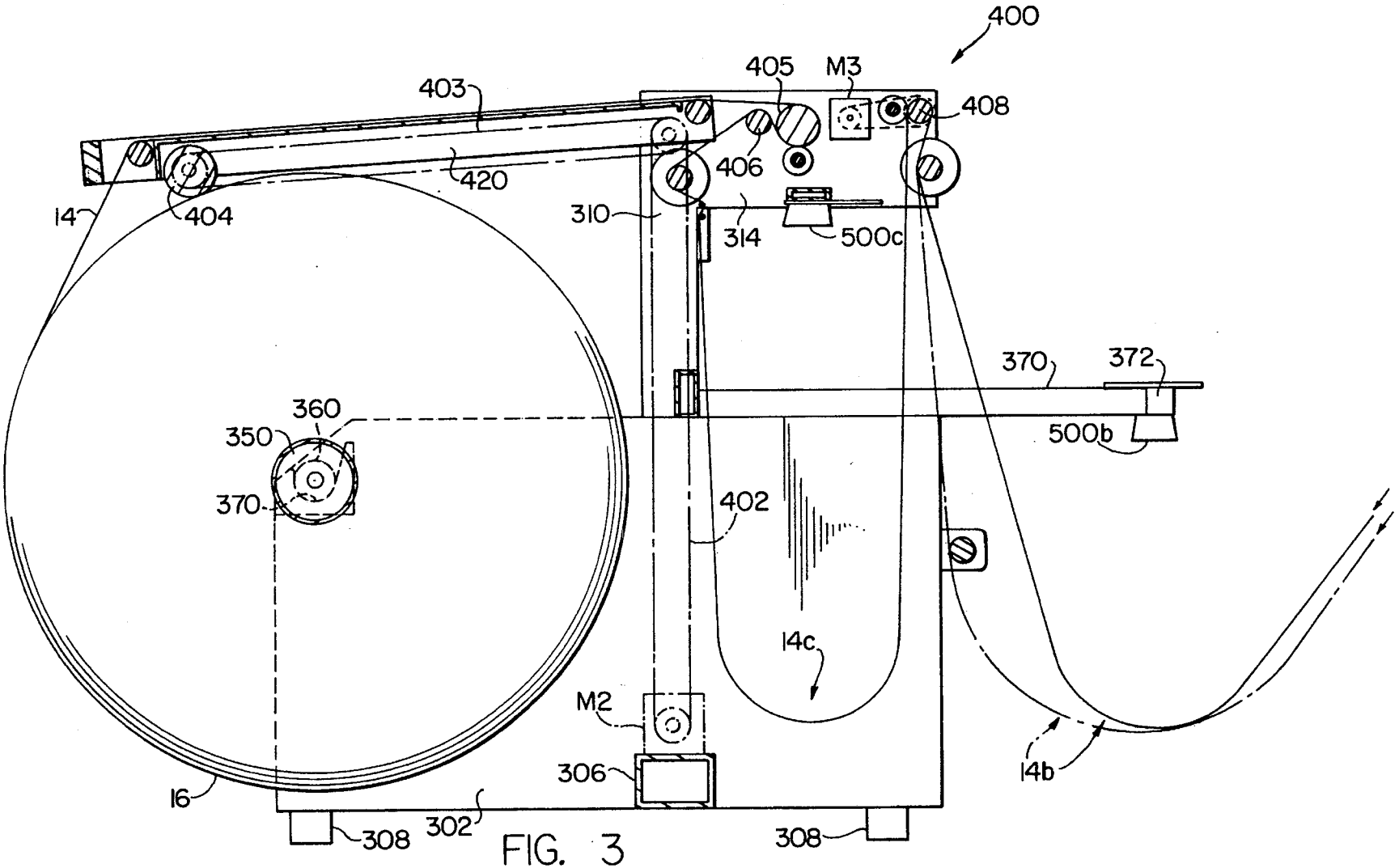
FIG. 3 shows in vertical elevation the rewind machine illustrated in FIG. 1, the phantom line in this view illustrating the paper web restrained by a guide bar provided in the rewind machine frame, and in the solid line view without such a restraint.

Similarly, and as shown in FIG. 3, the rewind machine 400 is adapted to receive the web of paper from the laser printer as indicated generally by the arrows at the right hand side of FIG. 3 with the guide rollers and backup wheels as well as a drag roller 405 being provided for forming two tension free loops as indicated generally at 14*b* and 14*c* in FIG. 3 with the result that the paper is wound on the roll 16 by the rewind machine 400.

DETAILED DESCRIPTION OF UNWIND MACHINE (FIGS. 2, 4 AND 7)

Figure 2:
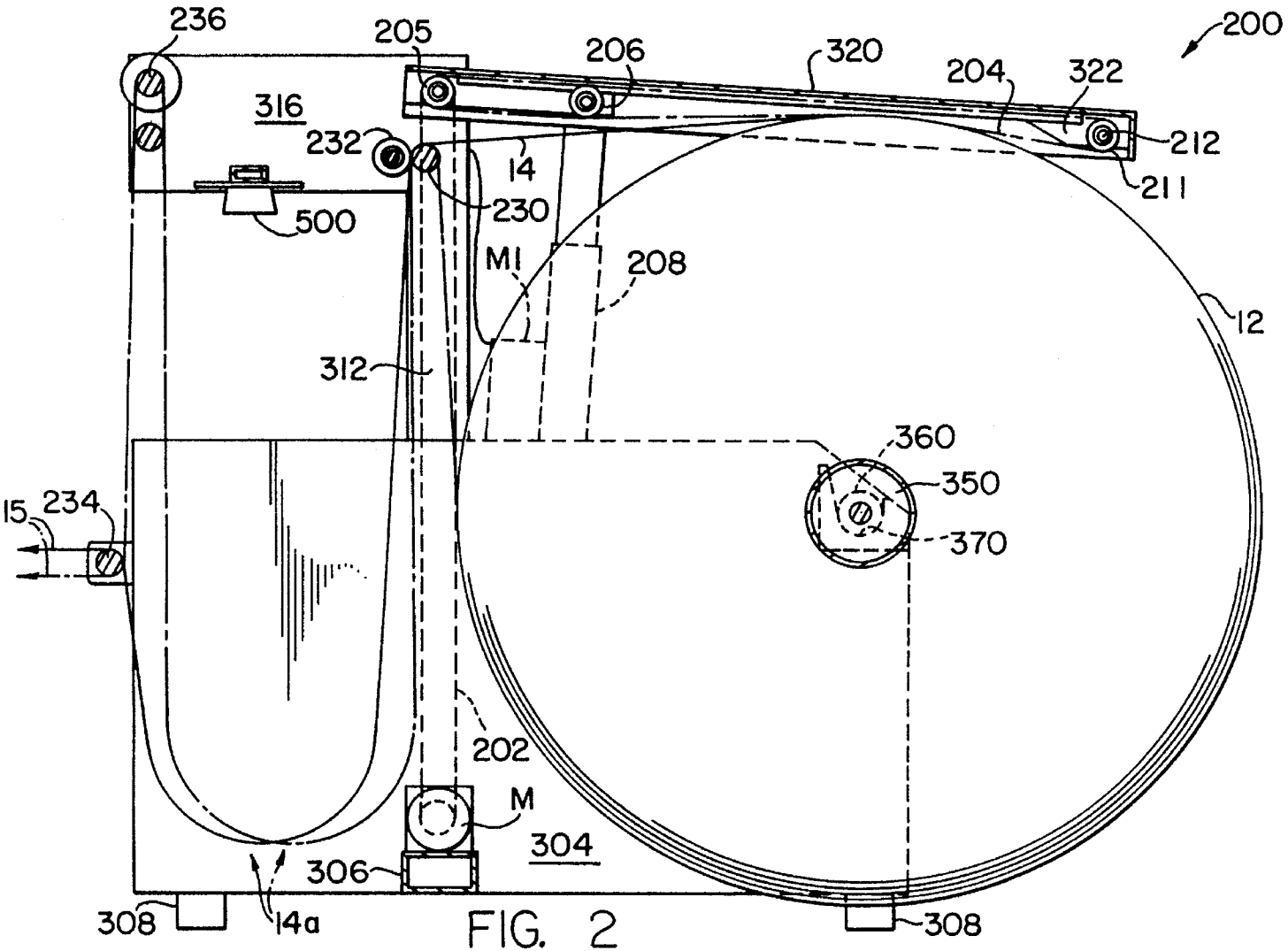
FIG. 2 shows in vertical section the unwind machine of FIG. 1 with the web of paper withdrawn from the top of the roll of paper. The phantom lines show the result of reversing the direction of rotation of the roll so that the paper web is drawn from the underside of the roll of paper.
Figure 4:
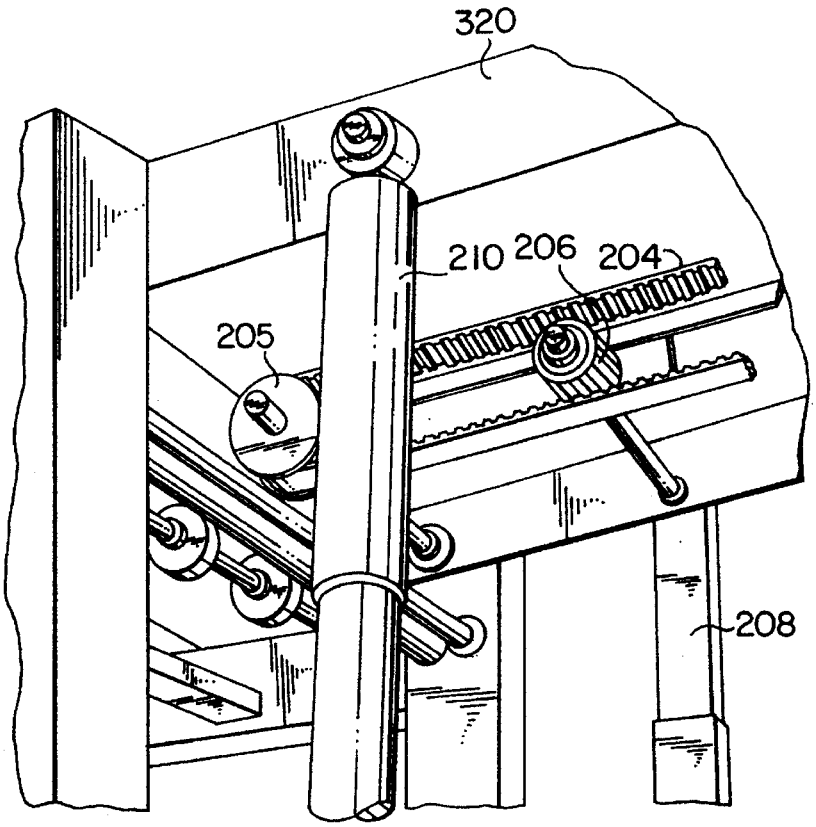
FIG. 4 is a perspective view looking upwardly under the pivoted end of the support beam for the conveyor belt in the unwind machine.

Turning now to FIG. 2 in greater detail, the roll of paper being unwound 12 is supported on a pneumatic roll core shaft 350 by means of roller bearings 360 provided at the ends of the roll core shaft. Each roller bearing 360 has its outer race contained in a U-shaped socket 370 provided for this purpose on the inside of each vertical side wall 302 and 304. An electric motor M is provided on the cross beam 306 of the machine frame, and the motor M operates, through a variable speed drive, to rotate the paper roll 12 through a vertically extending drive belt 202 and a drive belt 204 provided in the pivotably supported beam 320 that is mounted to the upper ends of the vertically extending uprights 310 and 312. A sprocket 205 is provided at the pivot axis of the beam 320. An idler sprocket 206 maybe provided in the pivotably supported beam 320 to aid in supporting the lower run of this belt 204, which belt is preferably in the form of a timing belt (that is having ribs that cooperate with teeth on the pulleys or sprockets that support it). FIG. 4 shows the drive belt 204 and also shows the backup wheel or idler sprocket 206 just described. The pivotably supported beam 320 that carries the drive belt 204 is normally biased by gravity against the periphery of the paper roll 12, but can be raised away from the roll by a jack screw provided inside the telescoping tube structure indicated at 208. The jack screw is driven by a reversible electric motor M1 best shown in FIG. 2. As best shown in FIG. 4 a shock absorber 210 is provided on the opposite side of the pivotably supported beam 320 from the telescoping tube structure 208 so as to prevent the drive belt 204 and the pivotably supported beam 320 from bouncing on the roll of paper 12 during the occasionally severe unwind conditions created by the intermittent speeds characteristic of laser printers.

Figure 7:
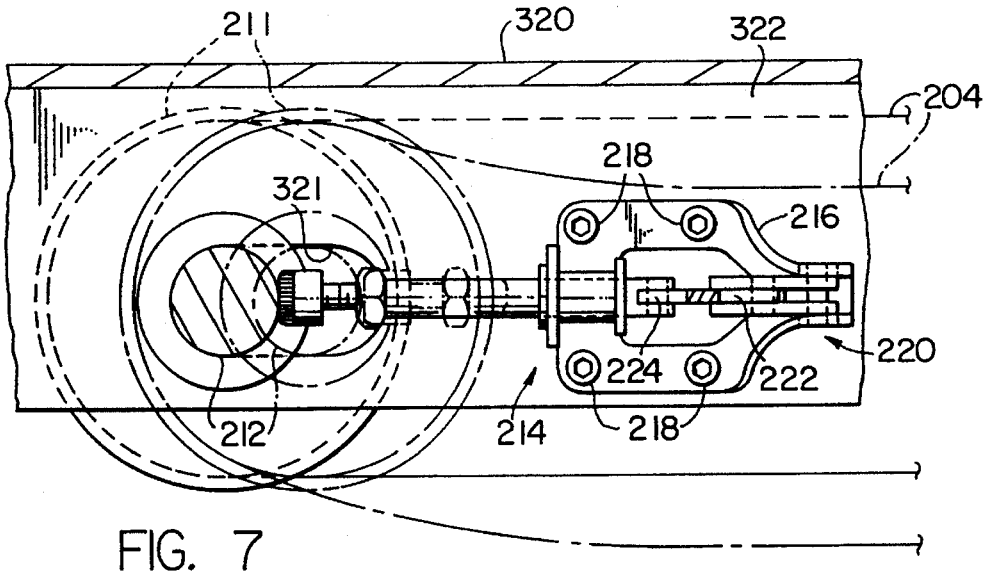
FIG. 7 is a side view taken on the line 7—7 of FIG. 6.
Figure 5:
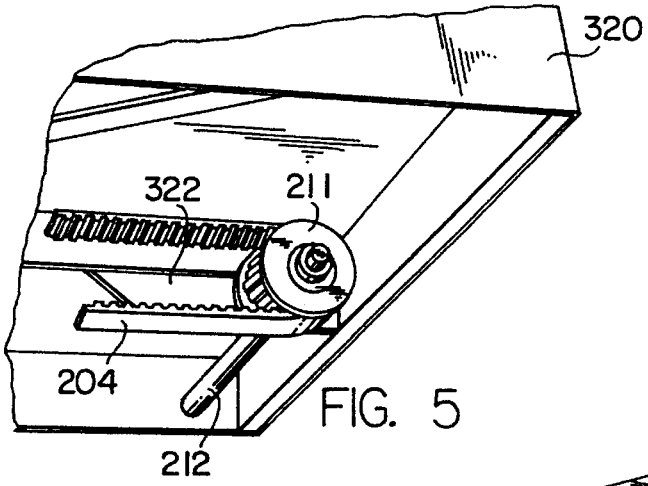
FIG. 5 is a view from the same vantage point as FIG. 4 illustrating the opposite end of the conveyor belt.
Figure 6:
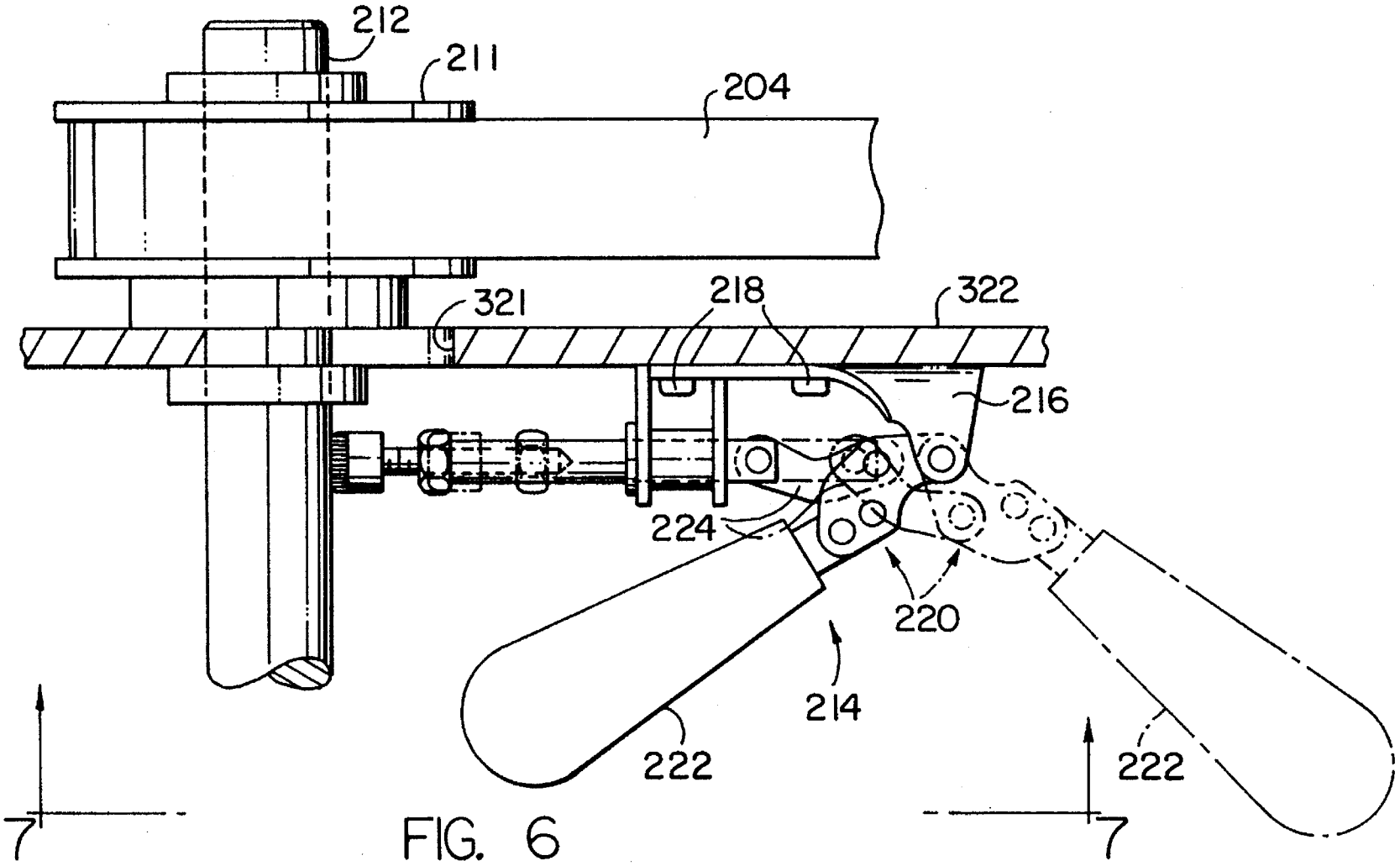
FIG. 6 is a detailed view of the outboard end of the conveyor belt illustrated in FIG. 5 showing the two position latch for releasing the outboard end sprocket to facilitate changing the belt (the release position is shown in phantom).

At the outboard end of the support beam 320 an idler sprocket 211 is provided for the drive belt 204. An important feature of the present invention in the unwind machine 200 is the ability to readily remove, for replacement, this drive belt 204. FIGS. 6 and 7 show the mechanism for accomplishing this task in detail. A stub shaft 212 for the outboard sprocket 211 is slidably supported in a slot 321 provided for this purpose in a plate 322 in the pivoted support beam 320. The stub shaft 212 is normally held in the solid line position shown for it in FIGS. 6 and 7 by a plunger structure 214 oriented at right angles to the axis of the stub shaft 212. The plunger structure 214 is slidably mounted in a bracket 216 secured to the plate 322 by screws 218. An over center latch 220 is provided with a handle 222 and bellcrank 224 such that movement of the latch handle from the solid line position shown in FIGS. 6 and 7 to the phantom line position shown allows the stub shaft 212 to move out of its active position as shown in full lines to a position where the slack belt 204 can be readily removed from the sprocket 211 (See FIG. 7).

The unwind machine of FIG. 2 can be used to draw paper web from the bottom of the paper roll, as indicated generally by the phantom lines for the web material in that view, or can instead be configured for withdrawing the web from the top of the paper roll as illustrated in full lines in FIG. 2. Considering first the full line configuration the paper web passes over a roller 230 which may be driven directly from the motor M provided on the cross beam 306 at a sufficient speed to maintain tension in the web 14 between the driven belt 204 and itself. Alternatively the roller 230 is driven by an independent electric motor at a speed sufficient to provide some slippage between the web material and the roller 230 in order to create a slight tension in the paper web between this driven roller 230 and the paper roll being unwound.

Backup wheels 232 are provided to maintain contact between the paper web and the tension roller 230. The paper web thereafter forms a tensionless free loop, as indicated generally at 14*a*, the web passing over a guide bar or roller 234 provided at a height to permit feeding of the web material into the laser printer as suggested generally by the arrow 15 at the end of the web 14. Alternatively, where the web is to be withdrawn from the lower side of the paper roll 12 as a result of rotating paper roll 12 in the opposite direction, the same tension roller 230 is provided so that the web travels over it and over a roller 236 provided at the upper end of the cantilevered arm 316, whence the web drops downwardly and passes around the guide bar 234 referred to previously, for entry into the laser printer. An ultrasonic detector 500 is provided for sensing the displacement between it and the lower portion of the tension free loop 14*a* in order to provide input to a control circuit that regulates the speed of the motor M which operates the driven belt 204. The control circuitry provided for using the signal from the ultrasonic detector for this purpose is well known, and the reader is referred to U.S. Pat. No. 4,384,665 issued to Waddington in 1983 for a more detailed description of such control circuitry in general.

DETAILED DESCRIPTION OF REWIND MACHINE (FIGS. 3 AND 10)

Turning now to the rewind machine of FIG. 3, the paper roll 16 is being rewound as the paper web is fed onto the roll 16 from the laser printer 10. A urethane coated drive roller 404 is driven from a motor M2 provided on the cross brace 306 of the machine frame for this purpose. A vertically extending drive belt 402 is operated through a variable speed drive for this purpose. A second drive belt 403 is provided at one side of the beam 420 to so operate the urethane coated roller 404. Tension is provided in the paper web 14 as it is being wound on the roll 16 by a second urethane coated roller 405 provided in the arms 314, 316 which are cantilever mounted to the uprights 310 and 312 in the machine frame. A drag brake is provided for this roller 405 and the drag brake is electrically controlled for impeding rotation of this roller 405 so as to create a drag on the web and thereby produce the desired tension in the web between the roller 405 and the rewind roll 16. This friction or drag roller 405 also provides a mechanism for the tension free loop 14*c* and the depth of this loop is continually sensed by an ultrasonic detector 500*c*.

While a single such tension free loop 14*c* and ultrasonic detector 500*c* might be suitable for some purposes, with the present state of technology in laser printers generally, and in order to meet the future requirements of other utilization devices such as slitters, and other equipment, means is provided for forming an additional tension free loop 14*b* between the rewind machine 400 and the utilization device. In order to form this second loop a small torque motor M3 is provided to drive a roller 408 associated with the downstream end of this second loop 14*b*. Another ultrasonic detector 500*b* is provided on a beam 370 mounted for this purpose in the machine frame. The beam 370 is mounted at one side of the machine on a short cantilevered cross beam 372. The depth of this loop 14*b* is monitored by the ultrasonic detector 500*b*.

Still with reference to the urethane roller 405 associated with creating the tension between itself and the rewind roll 16, it is a feature of the present invention that an idler roller 406 is provided adjacent to the roller 405 so as to provide a 270 degree wrap of the paper web around the urethane roller 405. Significant tension must be provided in the web between the urethane roller 405 and the rewind roll 16 so that it is important to provide this degree of wrap on the urethane roller 405. As a result of this web wrap under tension the roller 405 can become worn as a result of the continuous slippage necessarily incorporated into the design between itself and the paper web. When worn the roller 405 must be removed for replacement or repair by the machine operator. This can lead to significant downtime in the machine, and it is a feature of the present invention that means is provided for conveniently removing this urethane drag or friction roller 405.

Figure 10:
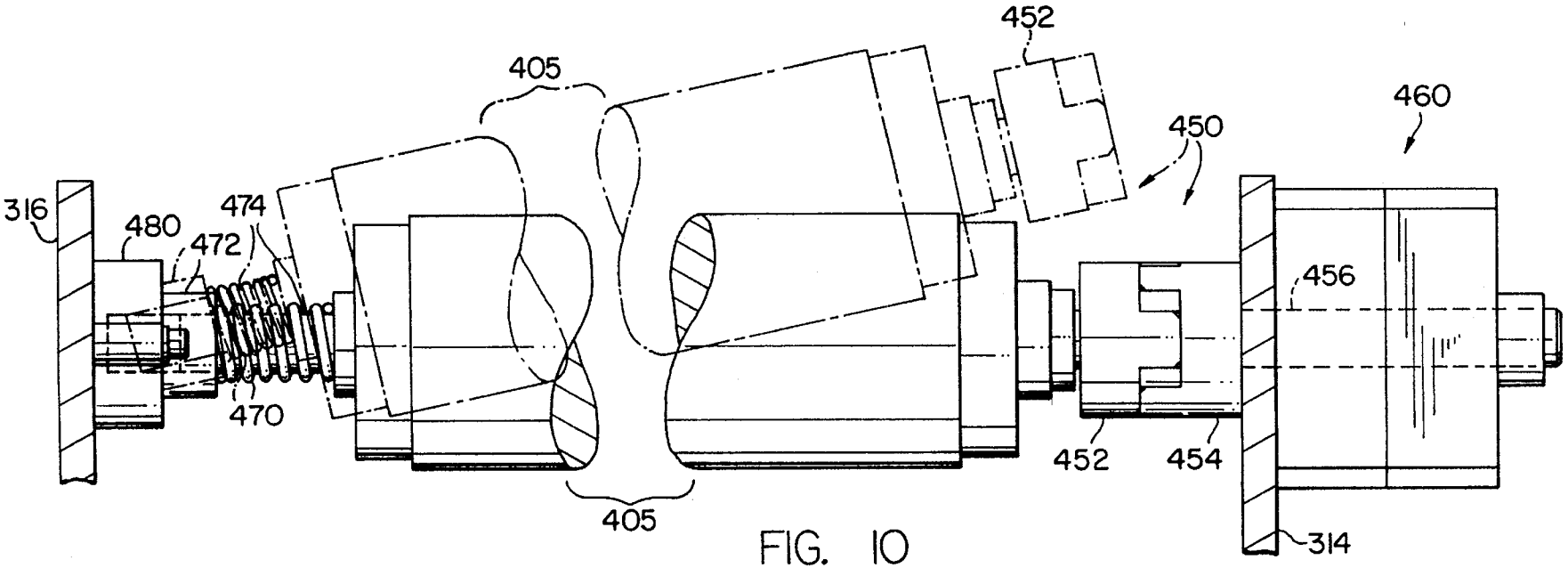
FIG. 10 is an elevational view of the drag or friction roller provided in the rewind machine for creating tension in the paper web between the tension free loop and the paper roll being rewound. The phantom line position for the drag roller illustrates roller in the process of being removed for replacement or repair.

Referring now to FIG. 10, the urethane roller 405 is shown mounted between the arms 314 and 316 in the machine frame. The urethane coated roller 405 has opposed ends provided with unique attachment means that permit its quick removal for replacement, and hence provides for the minimization of the down time in the rewind machine itself. Referring particularly to the right hand end portion of this drag roller 405 an axially separable coupling 450 is provided with one portion 452 on the end of the roller 405, and the other portion 454 that mates with it provided on a shaft 456. This shaft 456 is journalled in the plate 314 and an electromagnetic drag brake assembly 460 is provided to exert a drag force or torque on the urethane coated roller 405.

In order to permit separation of the coupling components 452 and 454 the left hand end of the roller 405 includes a spring 470 provided around a stub shaft 474 at the left hand end of the roller 405. This spring acts between the end of the roller 405 and a collar 472 secured to the shaft 474. The shaft 474 has an end portion that is axially movable toward the left in a recess defined for this purpose in the journal bearing 480. The journal bearing is mounted to the arm structure 316 by screws as shown, and the journal bearing also provides for limited angular movement of the shaft 474 and the roller 405 when the spring 474 is compressed so as to allow separation of the flexible coupling components 452 and 454 described previously. FIG. 10 shows in phantom lines the urethane coated roller 405 with the spring having been compressed and with the flexible coupling components separated so as to permit withdrawing the entire assembly from the socket defined at the left hand journal bearing 480.

I claim:

1. Machine for manipulating web material between a roll of the web material and a utilization device, said machine comprising, a frame having a base, and having upright supports extending vertically from the midpoint of said base, said base having spaced vertically extending side walls, and said side walls defining horizontally spaced sockets, a roll core shaft having end portions received in said sockets for supporting a roll of web material for rotation, variable speed drive means including an electric motor and a first member driven by said electric motor for engaging the periphery of the roll of web material to thereby rotate the roll, a beam for supporting said first member from said upright supports so that the first member contacts the periphery of the roll and accommodates changes in the roll diameter, means for guiding the web material between the utilization device and the roll, said web guiding means including a first roller having a substantial portion of its periphery defining a path for and frictionally engaging the web in order to provide tension in the web between said first roller and the roll, said web guiding means further including second web guiding means spaced from said first roller for creating a free loop of web material, sensing means for detecting changes in the length of said loop, control means responsive to said sensing means for changing the speed of said variable speed drive means to maintain the loop length within predetermined limits, said beam being pivotably supported on a horizontal axis defined by said upright supports, and means for selectively raising said pivotally supported beam away from the roll to permit removal and/or replacement of said roll in said machine, and wherein said drive member comprises one driven belt provided in said pivotally supported beam, and said variable speed drive means further including at least a second driven belt provided inside one of said vertical supports of said frame, and a sprocket assembly common to said one and said second drive belts and located at the horizontal axis of said pivotally supported beam.

2. The machine of claim 1, wherein said drive member comprising a drive belt extending substantially the entire length of said beam.

3. The machine of claim 2 further characterized by means for supporting said drive belt at the outboard end of said beam and including quick release means for said outboard drive belt support to facilitate removal for replacement of said drive belt.

4. The machine of claim 1 wherein said first roller includes electromagnetic operating means for imposing a predetermined torque on said first roller which torque creates a predetermined tension in the paper web between said first roller and the paper roll.

5. The machine of claim 1 wherein said first roller has opposite ends provided with end fittings that mate with complementary fittings provided in the machine frame, said end fittings permitting ready removal for replacement of said first roller.

6. The machine of claim 5 wherein said first roller is provided with an adjacent idler roller that maintains a substantial peripheral area of contact between said first roller and the paper web.

7. The machine of claim 6 wherein at least one of said end fittings comprises an angularly movable bearing support for the end of the shaft associated with said drive roller, and wherein said first roller is adapted to be moved axially to permit disconnecting the opposite end fitting associated with said driven roller.

8. The machine of claim 7 wherein said opposite end fitting for said first roller comprises a separable coupling that permits separation of the first roller from its fittings in the machine frame as a result of axial movement of the roller relative thereto.

9. The machine of claim 1 wherein said means for raising said pivotally supported beam includes a jack screw, and an additional electric motor for rotating said jack screw.

10. A roll-to-roll paper web unwinding and rewinding system for feeding paper into and out of a utilization device, said system comprising an unwind machine and a rewind machine, each said machine having a frame having a base, and having upright supports extending vertically from the midpoint of said base, said base having spaced vertically extending side walls, and said side walls defining horizontally spaced sockets, a roll core shaft having end portions received in said sockets for supporting a roll of web material for rotation, variable speed drive means including an electric motor and a first member driven from said motor, for engaging the periphery of the roll of web material to thereby rotate the roll, a beam for supporting said first member from said upright support so that the first member contacts the periphery of the roll and accommodates changes in the roll diameter, web guiding means for the web material as it moves between the utilization device and the roll, said web guiding means including a first roller having a substantial portion of its periphery defining a path for and frictionally engaging the web in order to provide tension in the web between it and the roll, said web guiding means further including second web guiding means spaced from said first mentioned roller for creating a free loop of web material, sensing means for detecting changes in the length of said loop, control means responsive to said sensing means for changing the speed of said variable speed drive means to maintain the loop length within predetermined limits, said beam being pivotably supported on a horizontal axis defined by said upright support means, and means for selectively raising said pivoted beam away from the roll to permit removal and/or replacement of said paper roll in said machine and wherein said rewind machine drive member comprises a driven roller provided at an outboard end of said pivotally supported beam, and said variable speed drive means including at least two driven belts, one belt being connected with said variable speed drive means and provided inside one of said vertical supports of said frame, and the second of said drive belts provided inside said pivotally supported beam, and a sprocket assembly common to said driven belts and located at the horizontal axis of said pivotally supported beam.

11. The system of claim 10 wherein said unwind machine has dampening means acting between said frame base and said pivotally supported beam, said drive member comprising a drive belt extending substantially the entire length of said beam.

12. The system of claim 11 wherein said unwind machine has means for supporting said drive belt at the outboard end of said pivotally supported beam and including quick release means for said outboard drive belt support to facilitate removal for replacement of said drive belt.

13. The system of claim 10 wherein each said machine has said first roller including electromagnetic operating means for imposing a predetermined torque on said first roller which torque creates a predetermined tension in the paper web between said first roller and the paper roll.

14. The system of claim 10 wherein said first roller has opposite ends provided with end fittings that mate with complementary fittings provided in the machine frame, said end fittings permitting ready removal for replacement of said first roller.

15. The system of claim 14 wherein said first roller is provided with an adjacent idler roller that maintains a substantial peripheral area of contact between said first roller and the paper web.

16. The system of claim 15 wherein at least one of said end fittings comprises an angularly movable bearing support for the end of the shaft associated with said drive roller, and wherein said first roller is adapted to be moved axially to permit disconnecting the opposite end fitting associated with said first roller.

17. The system of claim 16 wherein said opposite end fitting for said first roller comprises a separable coupling that permits separation of the first roller from its fittings in the machine frame as a result of axial movement of the roller relative thereto.

18. The system of claim 10 wherein said means for raising said beam includes a jack screw, and an additional electric motor for rotating said jack screw.

* * * * *